United States Patent [19]

Pongrass et al.

[11] Patent Number: 4,821,662

[45] Date of Patent: Apr. 18, 1989

[54] METHOD OF EMBROIDERY AND STITCH PROCESSOR THEREFOR

[75] Inventors: Robert G. Pongrass; William B. Wilson, both of Chippendale, Australia

[73] Assignee: Wilcom Proprietary Limited, Australia

[21] Appl. No.: 3,406

[22] PCT Filed: Apr. 18, 1986

[86] PCT No.: PCT/AU86/00104

§ 371 Date: Dec. 5, 1986

§ 102(e) Date: Dec. 5, 1986

[87] PCT Pub. No.: WO86/06423

PCT Pub. Date: Nov. 6, 1986

[30] Foreign Application Priority Data

Apr. 19, 1985 [AU] Australia ..... PH00206

[51] Int. Cl.[4] ..... D05C 5/02; D05C 5/04

[52] U.S. Cl. ..... 112/266.1; 112/103

[58] Field of Search ..... 112/121.12, 121.11, 112/102, 103, 456, 458, 445, 78, 98, 266.1, 262.1, 262.3

[56] References Cited

U.S. PATENT DOCUMENTS

| | | | |
|---|---|---|---|
| 4,116,144 | 9/1978 | Tanimoto et al. | 112/457 |
| 4,122,786 | 10/1978 | Tanimoto et al. | 112/454 |
| 4,200,048 | 4/1980 | Makabe et al. | 112/458 X |
| 4,242,974 | 1/1981 | Beckerman | 112/458 |
| 4,258,636 | 3/1981 | Rolauffs et al. | 112/121.12 |
| 4,309,950 | 1/1982 | Franklin | 112/121.12 X |
| 4,352,334 | 10/1982 | Childs | 112/266.1 |
| 4,368,682 | 1/1983 | Takenoya | 112/458 |
| 4,413,574 | 11/1983 | Horota et al. | 112/121.12 |
| 4,419,947 | 12/1983 | Makabe et al. | 112/456 |
| 4,444,134 | 4/1984 | Maruyama et al. | 112/121.12 |
| 4,502,402 | 3/1985 | Kato | 112/456 X |
| 4,526,116 | 7/1985 | Mannel | 112/266.1 |
| 4,622,907 | 11/1986 | Kimura | 112/103 X |
| 4,627,369 | 12/1986 | Conrad et al. | 112/121.12 X |
| 4,704,977 | 11/1987 | Nukushina | 112/103 X |

FOREIGN PATENT DOCUMENTS

| | | | |
|---|---|---|---|
| 0147087 | 7/1985 | European Pat. Off. | 112/103 |

*Primary Examiner*—Peter Nerbun

*Attorney, Agent, or Firm*—Kirschstein, Kirschstein, Ottinger & Israel

[57] ABSTRACT

A method of controlling an embroidery machine (3) using a stitch processor (1) by interpreting a low level language program containing stitch commands and varying the stitch commands to vary certain parameters of the design. The parameters which may be varied in any combination thereof include any of the following: stitch density, stitch length, size of the design independent of the stitch density, stitch spacing as a function of stitch length, orientation of the design, mirror image of the design and removing irregularities in the design. The parameters to be varied are entered by a keyboard-/display (2). The program may be read from a paper tape reader (4), directly from a computer system (5) used to generate the original stitch commands or any other input device. The modified stitch commands may be fed directly to an embroidery machine or stored in any of the usual methods for communicating to an embroidery machine at a later date.

20 Claims, 3 Drawing Sheets

METHOD OF EMBROIDERY AND STITCH PROCESSOR THEREFOR

FIELD OF THE INVENTION

This invention relates to a method and apparatus for controlling an automatic embroidery machine or the like.

BACKGROUND OF RELATED ART

Embroidery machines have been used for many years. These machines have generally been controlled by a program punched into a paper tape although recently electronic storage means have been deployed. The programs on the paper tape etc. which control the embroidery machines are generally in one of two formats, either a tape data format or a condensed data format. Both of these formats control the position of the work table of the machine plus other special functions such as change thread, start, stop etc.

A so-called tape data format contains the step by step commands which the machine executes, for example, move x axis, four steps; move y axis, minus two steps; stitch; etc. It is the lowest level of information on which a machine can work and is often referred to as low level language as each step to be performed by the machine is encoded on the tape.

A so-called condensed data format is a higher level language of pattern storage. This information contains the necessary parameters from which designs can be generated. This format does not tell the machine how far to move the work table etc. but requires the machine or design computer to generate the actual table movement sequence (incremental steps).

Each embroidery design requires a different program. The programs are generated on a design embroidery machine, a design computer or the like. Often called "punching machines" where the designer programs the design machine to generate the desired design. The program thus produced may be stored in, for example, the form of a punched paper tape or the like. To redesign the embroidery design, for example, to vary the density of the stitches or the size of the design of even the orientation of the design. requires reprograming and producing a new paper tape program for the production machines.

Designs which are generated in a condensed data format can be varied in size and stitch density since the information required for generation of incremental steps is provided in the nature of the condensed data format language, however this type of format is generally provided only on the so called "punching machines" which are used for creating the original designs and is not normally used on production machines.

A tape data format is normally used to drive production machines and generally cannot be varied. However, in recent times, these tape programs are able to be manipulated to provide scaling effects. That is, the size of a given design may be increased or decreased but this scaling is limited in its effect. The scaling is achieved by varying the actual stitch length, that is the incremental value between co-ordinate points is varied thus providing longer stitches or shorter stitches which in turn increase or reduce the size of the design. Even though the design may be scaled the actual number of stitches in the design stays the same. This has the disadvantage that when increasing the size of the design the density of the stitches may not be sufficient to provide adequate coverage by the fill stitches and satin stitches leaving areas where the base material shows through. Also, when decreasing the size of the design the stitches may tend to bunch up causing areas of unsatisfactory quality.

This problem has been overcome by using the condensed data format in which the density is determined by the machine when calculating the required stitch depths, but no machine nor device has previously been able to vary the actual stitch density of a design recorded in a tape data format.

BRIEF DESCRIPTION OF THE INVENTION

Thus, it is an object of this invention to provide an apparatus for varying the stitch densities of tape data format programs so as to overcome the aforementioned problems.

Accordingly, in one aspect the present invention consists in a method, of controlling an automatic embroidery machine, comprising the steps of:

(i) reading a low level language program incorporating stitch command;

(ii) interpreting the low level language to determine the stitch type and area covered; and (iii) modifying the stitch command in accordance with predetermined parameters.

Preferably, the method further includes the step of communicating the modified stitch commands to the automatic embroidery machine to produce a desired modified design.

Preferably, the low level language program is read from a punched paper tape or other equivalent electronic device.

Preferably, the predetermined parameters include modifying the stitch commands to vary the size of the design while maintaining the stitch density.

Preferably, the predetermined parameters include modifying the stitch commands to vary the stitch density independent of any scaling modification.

Preferably, the predetermined parameters include modifying the stitch commands to vary the stitch density of each different stitch type independently.

Preferably, the predetermined parameters include modifying the stitch commands to vary the orientation of the design.

Preferably, the predetermined parameters include modifying the stitch commands to produce a mirror image of the original design.

Preferably, the predetermined parameters include modifying the stitch commands to maintain the length of the stitches less than a maximum length.

Preferably, the predetermined parameters include modifying the stitch commands to maintain the length of each stitch type less than a respective maximum length.

Preferably, the modified stitch commands are communicated directly to the automatic embroidery machine.

Preferably, the stitch commands are modified to provide stitch spacings as a function of stitch length of certain stitch types.

Preferably, the low level language program is interpreted to recognize irregularities and inconsistencies in certain stitch types and the stitch commands are modified to smooth out the irregularities or inconsistencies.

In another aspect the present invention consists in a stitch processor adapted to be inserted between a tape file format program input device and the process controller of an automatic embroidery machine to adapt the stitch program from the program input device in accordance with desired parameters, said stitch processor comprising:

a central processing unit including a timer and an interrupt controller;

EPROM; RAM: address and data latches; and input and output devices, all interconnected by a common address/data bus.

Preferably, the device can modify the stitch commands provided by the input device in accordance with predetermined parameters to produce modified stitch commands for controlling the embroidery machine.

Preferably, the stitch commands are modified to vary any combination of the following features of the design:

size, independent of stitch density;

stitch density, in all or any combination of each different stitch type;

orientation of the design;

maximum fill stitch length;

maximum running stitch length; and maximum jump and satin stitch length.

Preferably, the stitch commands are modified to produce a mirror image of the original design.

Preferably, the stitch commands are modified to produce stitch spacings as a function of stitch length for certain stitch types.

Preferably, the stitch commands are modified to smooth out irregularities and inconsistencies in the original low level language program.

Preferably, the embroidery machine is replaced by a plotter to produce a pictorial representation of the modified design.

Preferably, the embroidery machine is replaced by an output device for recording the modified stitch commands.

BRIEF DESCRIPTION OF THE DRAWINGS

Notwithstanding any other forms that may fall within its scope, one preferred embodiment of the invention will now be described by way of example only with reference to the accompanying drawings in which.

DETAILED DESCRIPTION OF THE PREFERRED EMBODIMENTS

Figure 1:
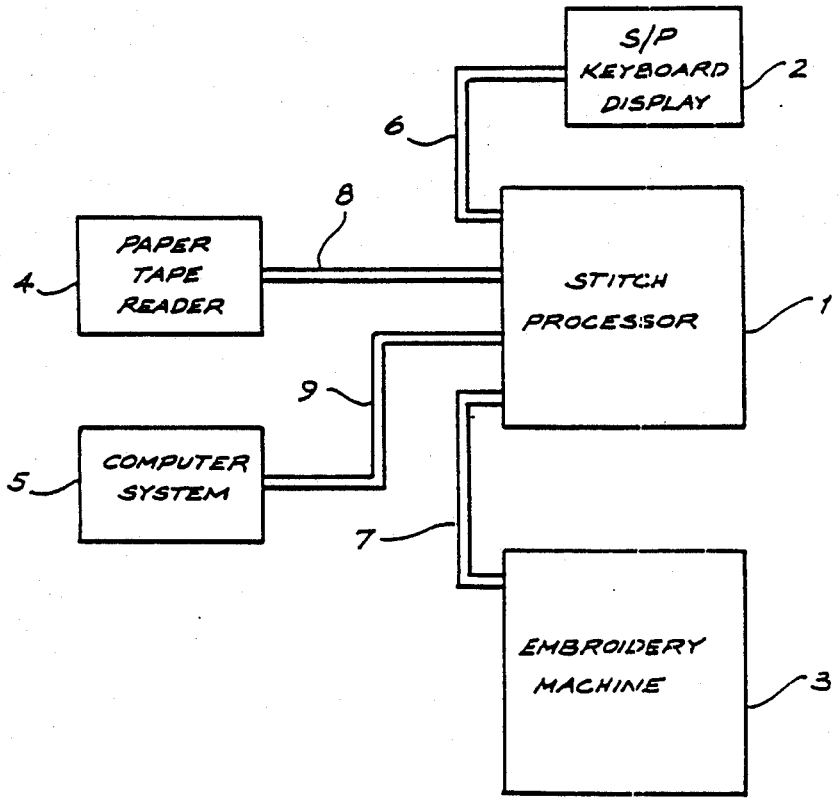
FIG. 1 is a black box diagram of the preferred embodiment showing connections to program input devices and an embroidery machine.

From FIG. 1 it can be seen that the preferred embodiment of the invention, known as a Stitch Processor (S/P), comprises two physical units, the S/P board (1) containing the various electronic devices for processing the stitch program and a S/P keyboard/display (2) interconnected by cable (6). Of course, these could be constructed as a single physical unit if so desired. The S/P board (1) is connected to the processor board of the embroidery machine (3) via cable (7) for parallel transmission of information. Thr S/P board (1) is connected to a device (4) for inputting the desired program via cable (8). In this case the device is an eight channel paper tape reader, but could be other devices such as a floppy disk reader or equivalent electronic or magnetic information transfer device such as magnetic tape or ROM device.

Thus it can be seen that the S/P is inserted between the reader (4) and the embroidery machine (3). In operation the S/P appears to the reader (4) as the embroidery machine and appears to the embroidery machine (3) as the reader. The S/P board (1) may also or alternatively be connected to a computer system (5) via cable (9) for direct production of computer generated designs, the computer system (5) functioning as the program input device.

The S/P keyboard/display (2) is provided to enable an operator to key in the required variations to the design being produced. Default values result in no modification to the design. Modifications to the design include:

1. variation in size (scaling);
2. variation in stitch density in all or any combination of the three different basic stitch types used, i.e. satin stitch, running stitch and fill stitch (also known as ceeding stitch or geflect stitch), although other stitch types may also be varied;
3. variation in the orientation of the design (i.e. the design may be rotated);
4. the design may be reversed to produce a mirror image of the original design;
5. variation in fill stitch length;
6. variation in running stitch length; and
7. variation in the maximum stitch length (as is used in satin stitch and jump commands).

Any combination of the above modifications may be made on the one design.

The scaling process varies the size of the design while maintaining the original density of the design unless it is also altered by the operator. This allows enlargement of the design without the previous disadvantage of gaps appearing in the design or a reduction in the size of the design without bunching of the stitches.

Figure 2:
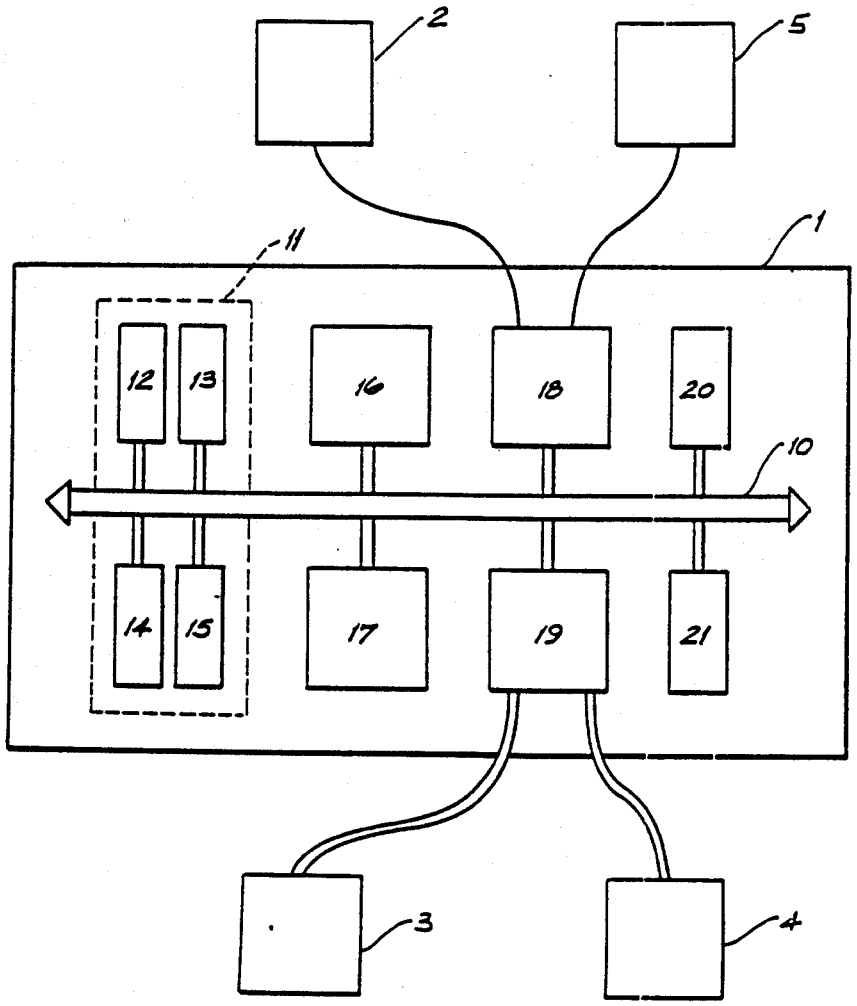
FIG. 2 is a block diagram of the arrangement in FIG. 1.

FIG. 2 shows the block diagram of the apparatus wherein it can be seen that the stitch processor board (1) comprises: a central processing unit (11), having a 8086 chip (12), a 8087 chip (13), a timer (14) and an interrupt controller (15), all connected to a common data/address bus (10) also connected to the bus are: an EPROM (16), containing the S/P program memory; RAM (17) for temporary storage of data; serial interface (UART) (18), for serial communication with the S/P keyboard/display (2) and the computer system (5); parallel I/O interface (19), for communication with the embroidery machine (3) and program reader (4); address latches (20); and data latches (21).

The S/P board (1) receives the required design variations from the operator via the keyboard/display (2). The display provides the operator with a visual verification of the inputted information and a remainder of the next step to be performed by the operator. Once a design has been started the display displays the progress of the design including the number of steps of the program read and the number of steps executed by the machine.

The S/P board receives the data supplied by the reader 4 or computer system (5), interprets the type of stitch being ordered by the program and the area involved. It then calculates the new steps required to modify the design as required and outputs the new steps to the embroidery machine's processor for controlling the machine to produce the required modified design. The information supplied to the S/P board via the reader (4) or computer system (5) is in the form of low level language (i.e. tape data format).

The stitch processor can also be adapted to modify a stitch spacing as a function of stitch length. This is desirable as the longer a stitch is the closer the stitches should be to maintain the visual density of the stitch pattern. This can be accomplished at the same time as the stitch processor is determining the stitch type, the area of the pattern and the stitch density of the modified design.

At the same time the stitch processor can be adapted to detect irregularities in the stitch pattern and to vary the modified design to smooth out the irregularities and inconsistencies to produce a neater design. Sometimes, especially in old programs, small irregularities were allowed to remain in the stitch program to avoid the expense of redesigning the entire program.

The S/P may also be used to produce modified programs which are recorded for future use or which may be directly outputted to a plotter or the like to produce a pictorial representation of the modified design.

Figure 3:
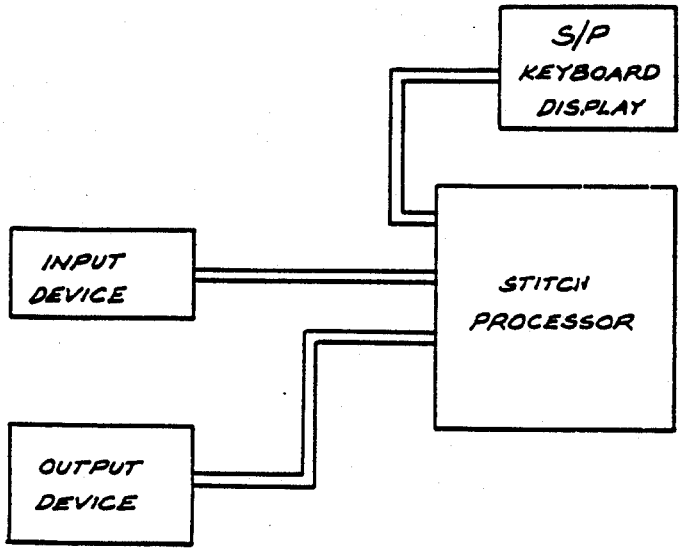
FIG. 3 is a black box diagram of another embodiment of the invention connected in a stand alone arrangement.

This is readily accomplished by the connections shown in FIG. 3, wherein the S/P keyboard/display are connected to an input device and to an output device. The input device may be any type of program input device including, but not limited to, any of the following:

paper tape reader, floppy disk reader, magnetic tape or cassette reader, bubble memory reader, EPROM or ROM reader, design computer system, etc.

The output device may be any type of output device including, but not limited, to any of the following:

paper tape puncher, floppy disk recorder, magnetic tape recorder, PROM programmer, graphics display system, plotter etc.

Although the preferred embodiment has been described as a separate processor device, the invention may well be incorporated into an automatic embroidery machine as an integral part of the machine's processor.

We claim:

1. A method of producing an embroidery pattern, comprising the steps of:

(a) reading a stitch-by-stitch definition of the embroidery pattern in tape data format incorporating fixed, step-by-step successive stitch commands, each command defining an individual stitch movement to form an individual stitch, successive commands defining successive individual stitch movements to form sequences of individual stitches which together constitute the embroidery pattern, each sequence being characterized by at least one stitch type, by a geometric area within the pattern, by stitches having lengths, and by stitches located at spacings relative to one another;

(b) analyzing each sequence of individual stitches throughout the embroidery pattern, and determining what stitch type, what area, what stitch lengths, and what stitch spacings characterize the respective sequence; and (c) automatically generating modified stitch commands in accordance with the determination of the stitch type, the area, the stitch lengths and the stitch spacings.

2. A method as defined in claim 1, wherein said step (c) includes varying the size of the embroidery pattern while maintaining its original stitch density.

3. A method as defined in claim 1, wherein said step (c) includes varying the stitch density independent of any scaling modification.

4. A method according to claim 3, wherein said step (c) includes varying the stitch density of each stitch type independently.

5. A method as defined in claim 1, wherein said step (c) includes varying the orientation of the pattern.

6. A method in accordance with claim 1, wherein said step (c) includes producing a mirror image of the original pattern.

7. A method as defined in claim 1, wherein said step (c) includes maintaining the length of the individual stitches less than a maximum length.

8. A method as defined in claim 6, wherein said step (c) includes maintaining the length of each stitch type less than a respective maximum length.

9. A method as defined in claim 1 wherein the step (c) includes providing stitch spacings as a function of stitch length of certain stitch types.

10. A method as defined in claim 1, wherein the step (b) includes detecting irregularities and inconsistencies in certain stitch types, and wherein the step (c) includes smoothing out the irregularities and inconsistencies.

11. A method as defined in claim 1, and further comprising the step of communicating the modified stitch commands to an automatic embroidery production machine operative for producing the embroidery pattern.

12. A stitch processor, comprising:

(a) means for reading a stitch-by-stitch definition of an embroidery pattern in tape data format incorporating fixed, step-by-step successive stitch commands, each command defining an individual stitch movement to form an individual stitch, successive commands defining successive individual stitch movements to form sequences of individual stitches which together constitute the embroidery pattern, each sequence being characterized by at least one stitch type, by a geometric area within the pattern, by stitches having lengths, and by stitches located at spacings relative to one another;

(b) means for analyzing each sequence of individual stitches throughout the embroidery pattern, and determining what stitch type, what area, what stitch lengths, and what stitch spacings characterize the respective sequence; and (c) means for automatically generating modified stitch commands in accordance with the determination of the stitch type, the area, the stitch lengths and the stitch spacings.

13. A method as defined in claim 1 or claim 11, wherein the definition is a low level language program stored on one of the devices contained in the following group: punched paper tape, floppy disk, magnetic tape, ROM, PROM, EPROM, bubble memory and a design computer system.

14. A stitch processor in accordance with claim 12, wherein the generating means is operative to vary any combination of the following features of the pattern:

size, independent of stitch density;

stitch density, in all or any combination of each stitch type;

orientation;

maximum fill stitch length;

maximum running stitch length; and maximum jump and satin stitch length.

15. A stitch processor in accordance with claim 12, wherein the generating means is operative to produce a mirror image of the original pattern.

16. A stitch processor in accordance with claim 12, wherein the generating means is operative to produce stitch spacings as a function of stitch length for certain stitch types.

17. A stitch processor in accordance with claim 12, wherein the generating means is operative to smooth out irregularities and inconsistencies.

18. A stitch processor in accordance with claim 12, wherein the embroidery and further comprising means for plotting a pictorial representation of the modified pattern.

19. A stitch processor in accordance with claim 12, and further comprising means for recording the modified stitch commands.

20. A stitch processor as defined in claim 12, and further comprising means for communicating the modified stitch commands to an automatic embroidery production machine operative for producing the embroidery pattern.

* * * * *